US005791123A

United States Patent [19]

Bolz

[11] Patent Number: 5,791,123

[45] Date of Patent: Aug. 11, 1998

[54] METHOD AND APPARATUS FOR DECANTING HAZARDOUS SUBSTANCES INTO CONTAINERS

[75] Inventor: Alfred Bolz, Uhlandweg, Germany

[73] Assignee: Helpmann Verfahrenstechnik GmbH, Wanuen, Germany

[21] Appl. No.: 216,039

[22] Filed: Mar. 22, 1994

[30] Foreign Application Priority Data

Mar. 23, 1993 [DE] Germany ..... 43 09 373.6

[51] Int. Cl.[6] ..... B65B 31/00

[52] U.S. Cl. ..... 53/434; 53/449; 53/469; 53/570; 53/502; 53/170; 53/512

[58] Field of Search ..... 53/449, 434, 170, 53/512, 469, 570, 502; 141/97, 65

[56] References Cited

U.S. PATENT DOCUMENTS

| | | | |
|---|---|---|---|
| 3,190,441 | 6/1965 | Rausing | 53/449 |
| 4,112,124 | 9/1978 | Tarvis | 53/434 |
| 4,172,152 | 10/1979 | Carlisle | 53/434 |
| 4,825,913 | 5/1989 | Stott | 141/65 |
| 4,991,633 | 2/1991 | Wong | 53/434 |
| 5,109,651 | 5/1992 | Stuart | 53/167 |
| 5,170,609 | 12/1992 | Bullock et al. | 53/434 |

*Primary Examiner*—John Sipos
*Assistant Examiner*—Gene L. Kim
*Attorney, Agent, or Firm*—Brown, Martin, Haller & McClain

[57] ABSTRACT

A method of decanting hazardous substances into containers, in which the substances to be decanted are divided into portions and packaged at the outlet of a production plant via an upper glove box, a lock chamber and a drum container under clean room conditions, wherein the drum container is positioned beneath the sealing device on the upper glove box on a weighing platform, and an upper ring flange of the drum container is sealed by inflating an inflatable seal, and a passage between the glove box and a space with the drum container is opened, and further the operator pulls an outer bag out of the drum container over the flange in the glove box and fastens it.

12 Claims, 14 Drawing Sheets

METHOD AND APPARATUS FOR DECANTING HAZARDOUS SUBSTANCES INTO CONTAINERS

FIELD OF THE INVENTION

The invention concerns a method and an apparatus for decanting hazardous substances into containers, in particular into bags, in which the substances to be decanted are divided into portions and packaged at an outlet of a production plant via a glove box, a lock chamber and a drum container under clean room conditions.

BACKGROUND OF THE INVENTION

A method of this kind and an associated plant has become known with EP 521 252 A1 or DE 91 07 768 U, which goes back to the same applicant. In this known decanting plant there are two boxes one above the other, wherein the upper box is constructed as a glove box in order to be able to perform the corresponding manipulations at the filler head under safe conditions.

It was also a characteristic of the earlier patent application that beneath the upper glove box was arranged a second, lower glove box in which the drum to be filled was arranged with the filling bags arranged therein.

The use of two glove boxes located one above the other, however, makes the plant costly and relatively difficult to operate.

Moreover there was a transition opening which could not be sealed between the upper glove box and the lower glove box, which was associated with the disadvantage that under certain conditions the air located in the drum to be filled and the lower chamber could pass via this open transition opening into the upper glove box, which could result in contamination of the air in the upper chamber.

It is therefore the object of the invention to develop a method and an apparatus of the kind mentioned hereinbefore in such a way that an operationally reliable method is ensured with lower production costs for the apparatus.

SUMMARY OF THE INVENTION

To achieve the set object, one aspect of the invention comprises a method for decanting hazardous substances into containers, in which the substances to be decanted are divided into portions and packaged at an outlet of a production plant via an upper glove box, a lock chamber and a drum container under clean room conditions, comprising the steps of:

a) positioning the drum container beneath a sealing device on the upper glove box on a weighing platform;

b) sealing an upper ring flange of the drum container by inflating an inflatable seal;

c) opening a passage between the glove box and a space with the drum container;

d) pulling an outer bag out of the drum container over a flange in the glove box and fastening said bag;

e) fastening an inner bag from the drum container at the outlet of the production plant;

f) performing filling and weighing operations and closure of the outlet after filling has taken place;

g) evacuating the inner bag;

h) closing and stuffing into the drum container the inner bag and then the outer bag and hermetically sealing the drum container;

i) hermetically sealing the glove box off from the chamber for the drum container.

From another aspect, the invention comprises apparatus for carrying out the method of decanting hazardous substances according to the first aspect, comprising a weighing platform provided under the glove box; a weighing frame arranged on the weighing platform for the drum container as part of a weighing device; a device for sealing off from the glove box; an opening between the glove box and the drum container serving as a lock chamber which can be hermetically sealed; an inflatable seal in the weighing frame, said seal contacting an upper ring flange of the drum container without pressures in relation to weighing; and an inner bag and an outer bag provided in the drum container.

It is an essential characteristic of the invention that a lower glove box can now be eliminated in general and that the drum itself functions as a lock chamber by sealingly contacting a sealing device arranged on the lower side of the upper glove box, and forming a fully enclosed atmosphere.

Due to the elimination of a lower glove box, the apparatus is thus substantially cheaper to make, because all the corresponding parts can be eliminated.

It is another essential characteristic of the invention that a sealing device is now provided in the transition region between the upper chamber (glove box) and the drum arranged sealingly underneath, which sealing device essentially consists of a swinging lid which either releases the opening between the glove box and the drum underneath with sealing via certain sealing rings, or closes it with sealing.

In the earlier patent application, moreover, there was no description of air conduction in the glove box via corresponding filters and fans as well as corresponding possibilities of cleaning.

The essence of the method lies in that first of all in a first step the drum is placed on a weighing platform beneath the sealing device on the upper glove box and then the upper ring flange of the drum is sealed at an inflatable seal, which seal forms part of a frame which is placed on the weighing device and also weighed by the weighing device. In order to avoid falsification of the result of weighing, according to the invention it is provided that this weighing frame is sealed by a flexible ring tube in a direction towards the glove box, so that there is no application of force from the weighing frame to the upper glove box.

Similarly it is important that due to the arrangement of an inflatable seal in a weighing frame, which inflatable seal is applied in force-locking and form-locking relationship to the upper ring flange of the drum, no sealing forces can falsify the result of weighing either, because it is a closed system which is mounted on the weighing device and hence no external forces can be applied to this system.

It is therefore now possible for the first time to hold a drum sealingly in a weighing frame, which weighing frame is arranged via a flexible ring tube on the lower side of the upper glove box, as a result of which absolutely tight sealing off of the whole system from the atmosphere is achieved.

It is another characteristic of the method that in certain steps a swinging lid is actuated, which selectively opens and closes the opening on the lower side of the glove box in a direction towards the sealingly held drum.

The subject of the present invention arises not only from the subjects of the individual patent claims, but also from the combination of the individual patent claims with each other. All the details and characteristics disclosed in the documents including the abstract, particularly the spatial construction shown in the drawings, are claimed as essential to the invention in so far as they are novel compared with the state of the art individually or in combination.

Below, the invention is described in more detail with the aid of drawings which show only one embodiment. Here, further characteristics essential to the invention and advantages of the invention are apparent from the drawings and the description thereof.

DETAILED DESCRIPTION OF THE PREFERRED EMBODIMENT OF THE INVENTION

Figure 1:
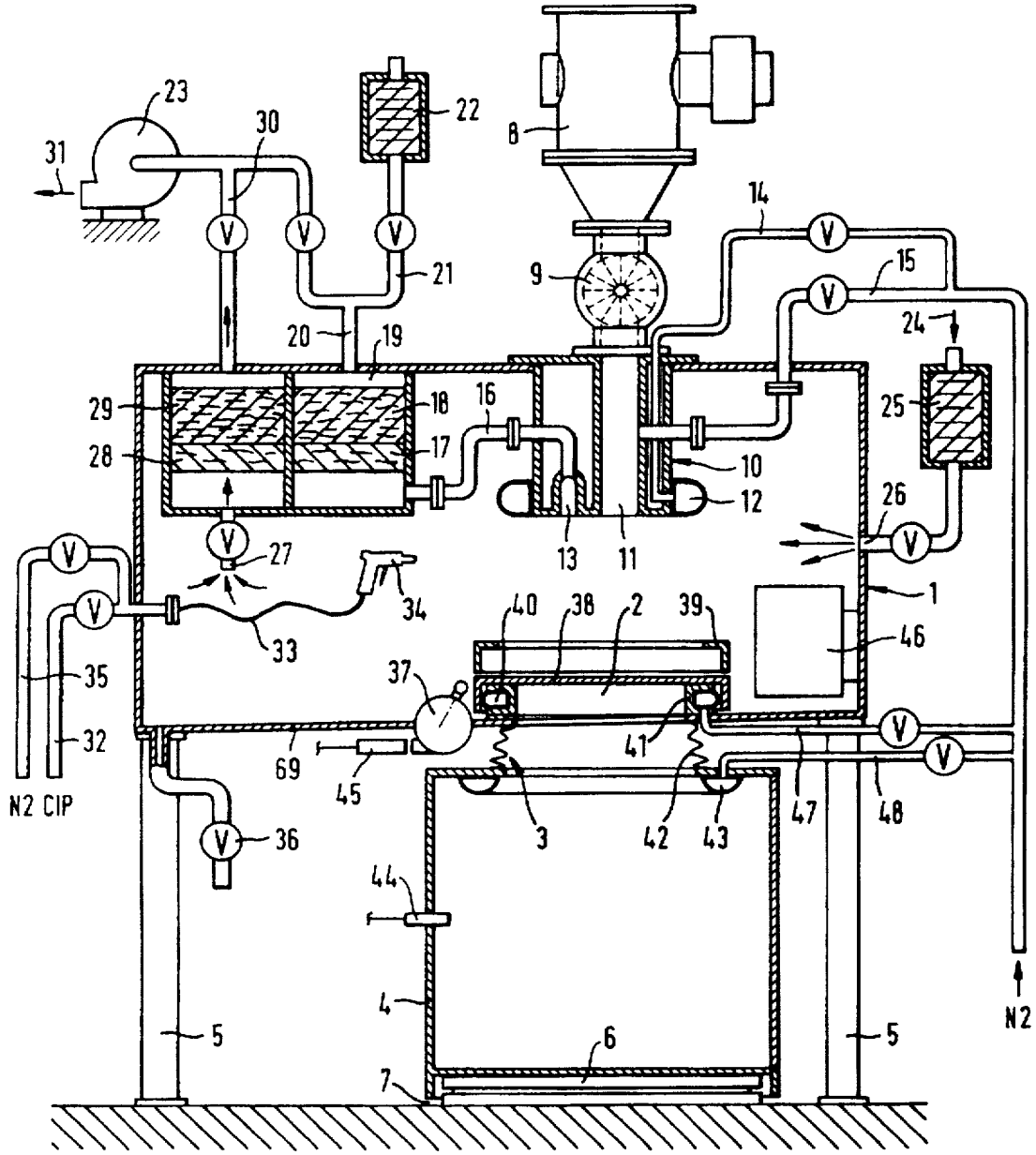
FIG. 1: schematised, a plant according to the invention in the starting position.

According to FIG. 1, the plant essentially consists of an upper glove box 1 which comprises a lower opening 2 in a bottom plate 69, wherein beneath the opening 2 is arranged a sealing device 3 which forms part of a frame 4 which rests on the weighing platform 6.

The glove box 1 for its part stands on a frame 5 on the ground.

It is important that the frame 4 mounted on the weighing platform has a ground clearance 7, so that this frame forms part of the weighing device itself.

Filling with liquid or granular substances takes place via a discharge valve 8 which is connected to a feed system, not shown in more detail. On the lower side of the discharge valve 8 can be arranged a metering device 9, and the outlet of the metering device leads via a filler head 10 into the glove box 1.

Part of the filler head 10 is a filler pipe 11 which at its outer circumference comprises an inflatable seal 12 which is inflatable and deflatable pneumatically via a pipe 14.

Also part of the filler head 10 is an extraction connection 13 via which, by means of a pipe 16, extraction from the bag to be filled can take place.

Into the filler head 10 leads another pipe 15 which can introduce an inert gas into the filler head 10 in order to render it inert.

Air conduction in the glove box takes place in the arrow direction 24 via an air inlet filter 25 which leads via an intake opening 26 into the glove box 1. Air which flows in via the intake opening 26 is extracted from the glove box 1 via the preliminary filter 17 and the main filter 18. The air passing through the filters 17, 18 accumulates in a collecting chamber 19 and is either fed via a pipe 20 selectively via air outlet filter 22 to the atmosphere or drawn off via a fan 23 in arrow direction 31.

Instead of the air outlet filter 22 which is connected to the pipe 21, the pipe 21 can also be returned directly into a product collecting chamber for the product to be decanted, not shown in more detail.

The filters 17, 18 are intended to filter and remove the air passing through the pipe 16 from the filler head 10, while additional filters 28, 29 are to filter the air circulating in the chamber itself via an intake opening 27 and a flap valve, and remove it via the pipe 30.

Due to inflow of the air at the intake opening 26 and outflow via the intake opening 27, a partial pressure is therefore generated in the glove box, which prevents contaminated air from passing out of the glove box 1 into the environment.

There are also cleaning devices, wherein a cleaning medium is introduced into the chamber via a pipe 32, wherein on a flexible hose 33 is arranged a spray gun 34 which by operation through the glove openings can be directed at any point in the glove box 1.

Via the pipe 35, a drying medium can be introduced into the chamber.

The bottom plate 69 is inclined in a direction towards one corner of the glove box 1, so that a run-off opening with a valve 36 underneath is defined and the cleaning medium can be removed via this run-off opening.

In the normal state (initial state), the opening 2 between the glove box 1 and the bare frame 4 underneath is hermetically sealed. For this, there is used a swinging lid 38 which can be pivoted by a lever 37 into two different pivot positions. On the swinging lid 38 is mounted a sealing ring 39 which in FIG. 1 has as yet no sealing function.

The sealing device 3 essentially consists of the said swinging lid 38 and a peripheral inflatable seal 40 which is arranged in the region of an outwardly opening flange 41 profiled in a U-shape. On the flange 41 is sealingly mounted a flexible ring tube 42 which is connected to the upper side of the frame 4. On the frame 4 is arranged a vertical, downwardly directed, inflatable second seal 43. The seals 41, 43 can be aerated and deaerated via the pipes 47, 48.

To establish whether there is a drum in the frame 4 or not, a proximity sensor 44 is arranged on the frame 4.

Another proximity sensor 45 detects the pivot position of the lever 37, namely whether the swinging lid 38 is in one or the other pivot position.

Figure 2:
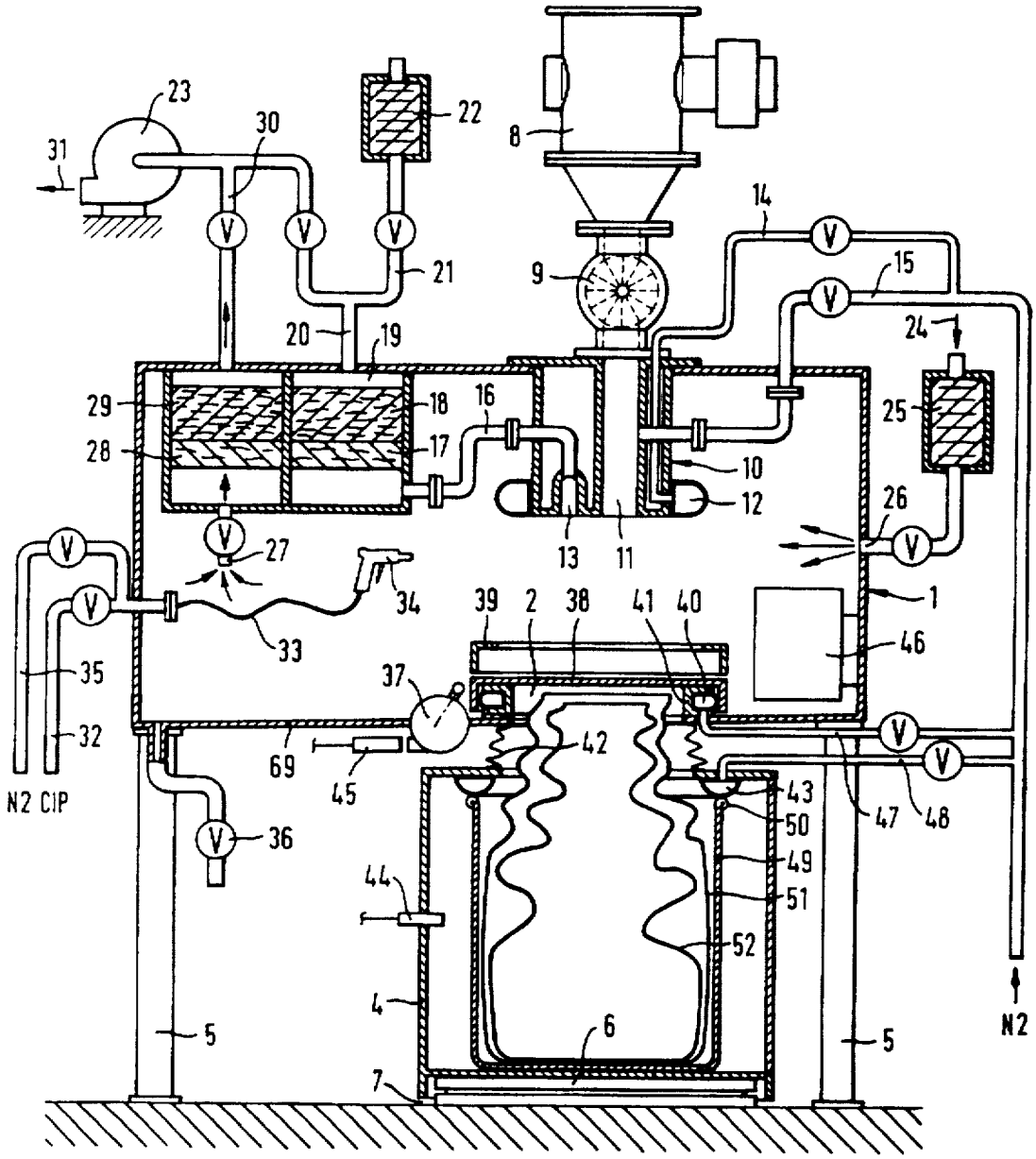
FIG. 2: the plant after introducing and sealing the drum.
Figure 3:
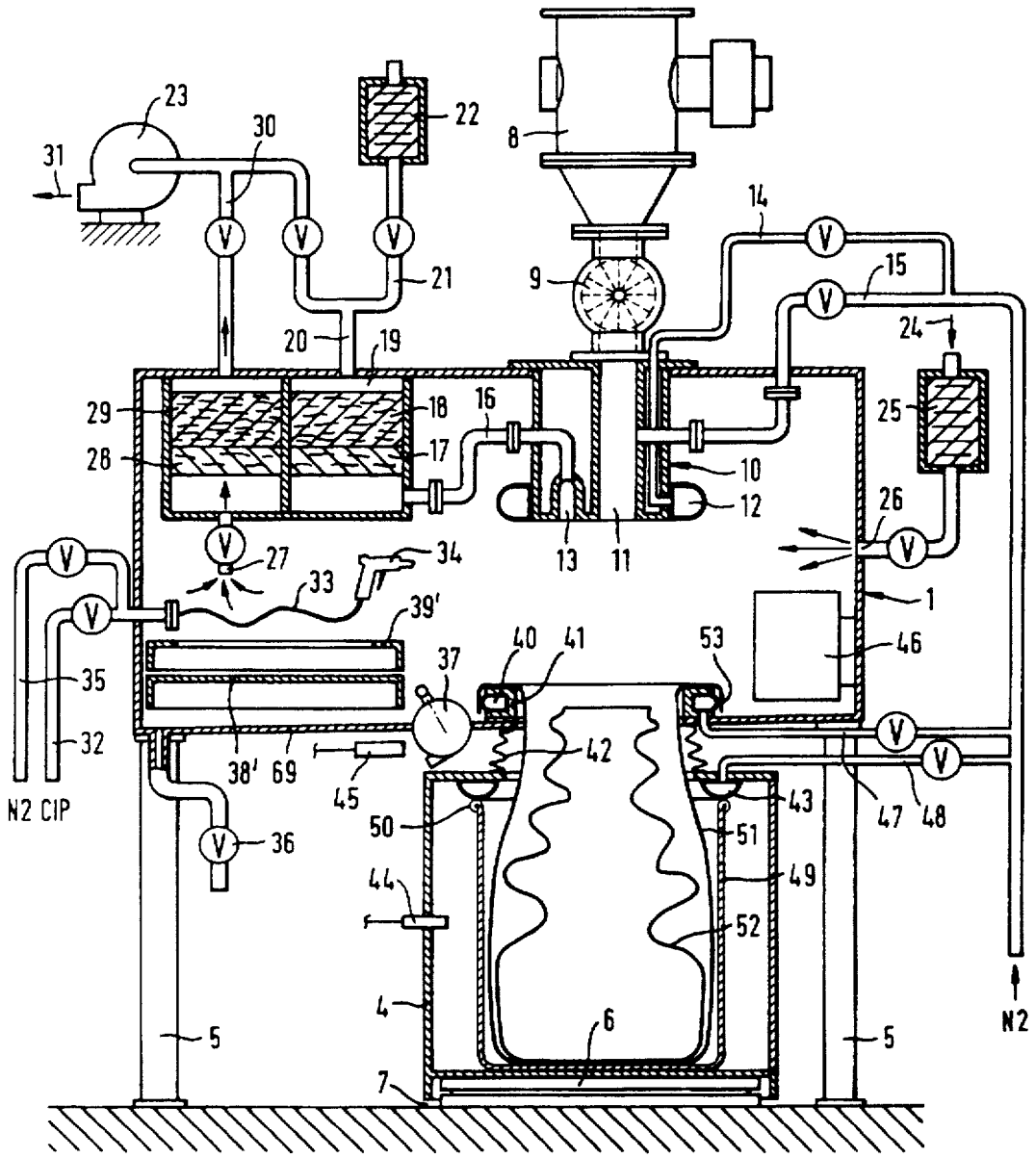
FIG. 3: the plant with the outer bag fastened.

According to FIG. 2, a drum 49 is now placed on the weighing platform 6 and the seal 43 is inflated, as a result of which the ring flange 50 of the drum is applied sealingly to the seal 43.

As described at the beginning, this sealing does not alter the weighing result because the seal 43 is arranged on the frame 4 and the frame 4 in turn stands on the weighing platform 6. It is therefore a self-contained system of forces, which is not supported by an additional force on external parts.

The dead weight of the frame and seal 43 is compensated by taring the weighing device.

In the drum 49 there are two bags, namely an outer bag 51 and an inner bag 52. Both bags 51, 52 are open.

Figure 4:
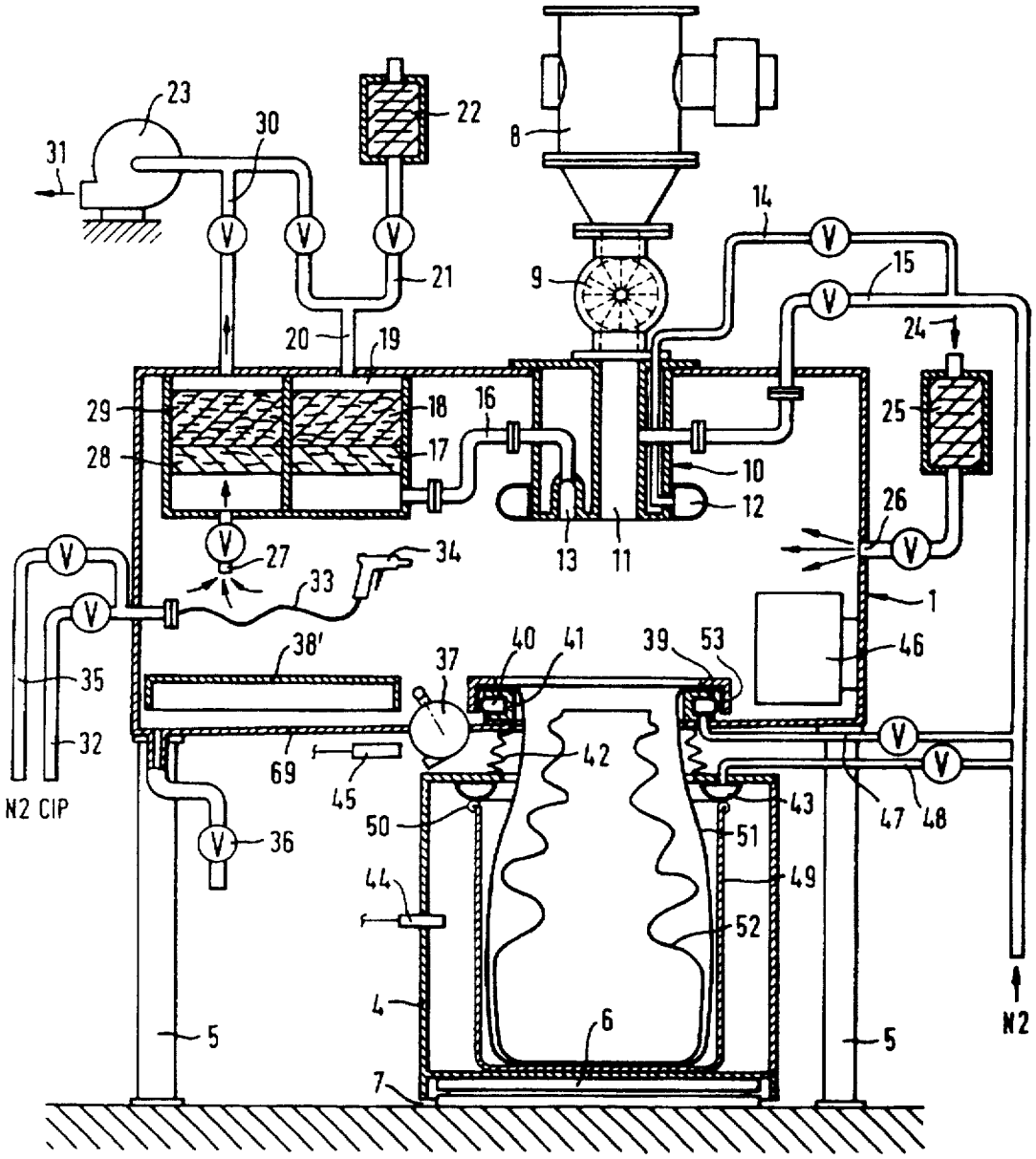
FIG. 4: the plant with the outer bag sealed.

By operation of the lever 37, the swinging lid 38 with the sealing ring 39 located thereon is pivoted into the position 38', 39', so that the opening 2 now becomes free. The edge 53 of the outer bag 51 is now pulled up by the plant operator and laid over the flange 41. The adjacent sealing ring 39' is then fitted according to FIG. 4, so that it assumes its position 39, as a result of which the edge 53 of the outer bag 51 is fixed. According to FIG. 5, the inner bag 52 is now pulled up so that its edge is applied to the inflatable seal 12 which forms part of the filler head 10.

The seal 12 is inflated via the pipe 14.

Figure 6:
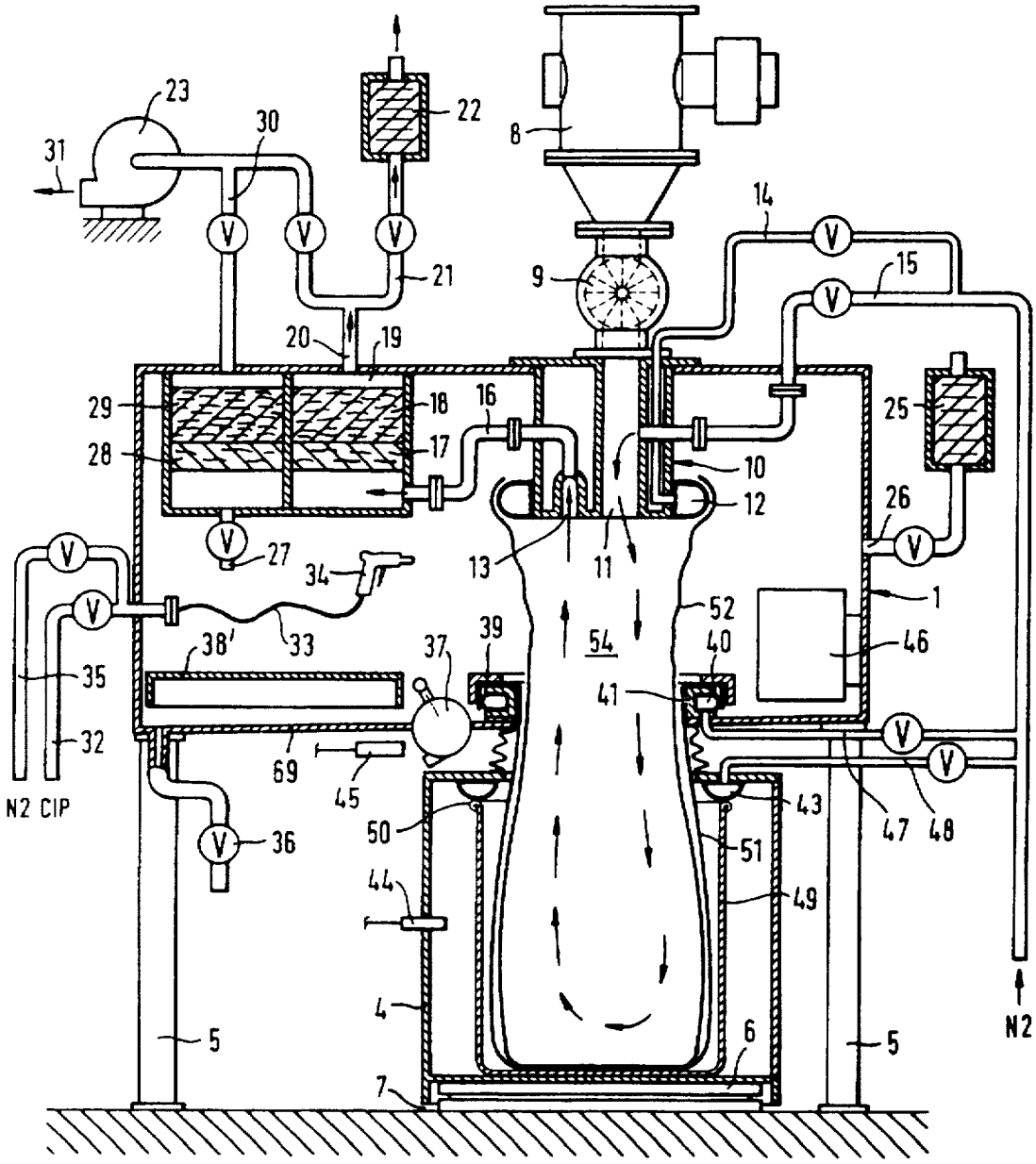
FIG. 6: the plant showing aeration of the inner bag.

According to FIG. 6, the interior of the inner bag 52 can now be rendered inert by introducing via the pipe 15 through the inner bag 52 an inert gas which scavenges the interior 54 in the arrow directions shown and which is extracted again via the pipe 16 and the filters 17, 18 and via the fan 23.

This aeration of the inner bag 52 is only optional and is not necessary for all applications.

Figure 7:
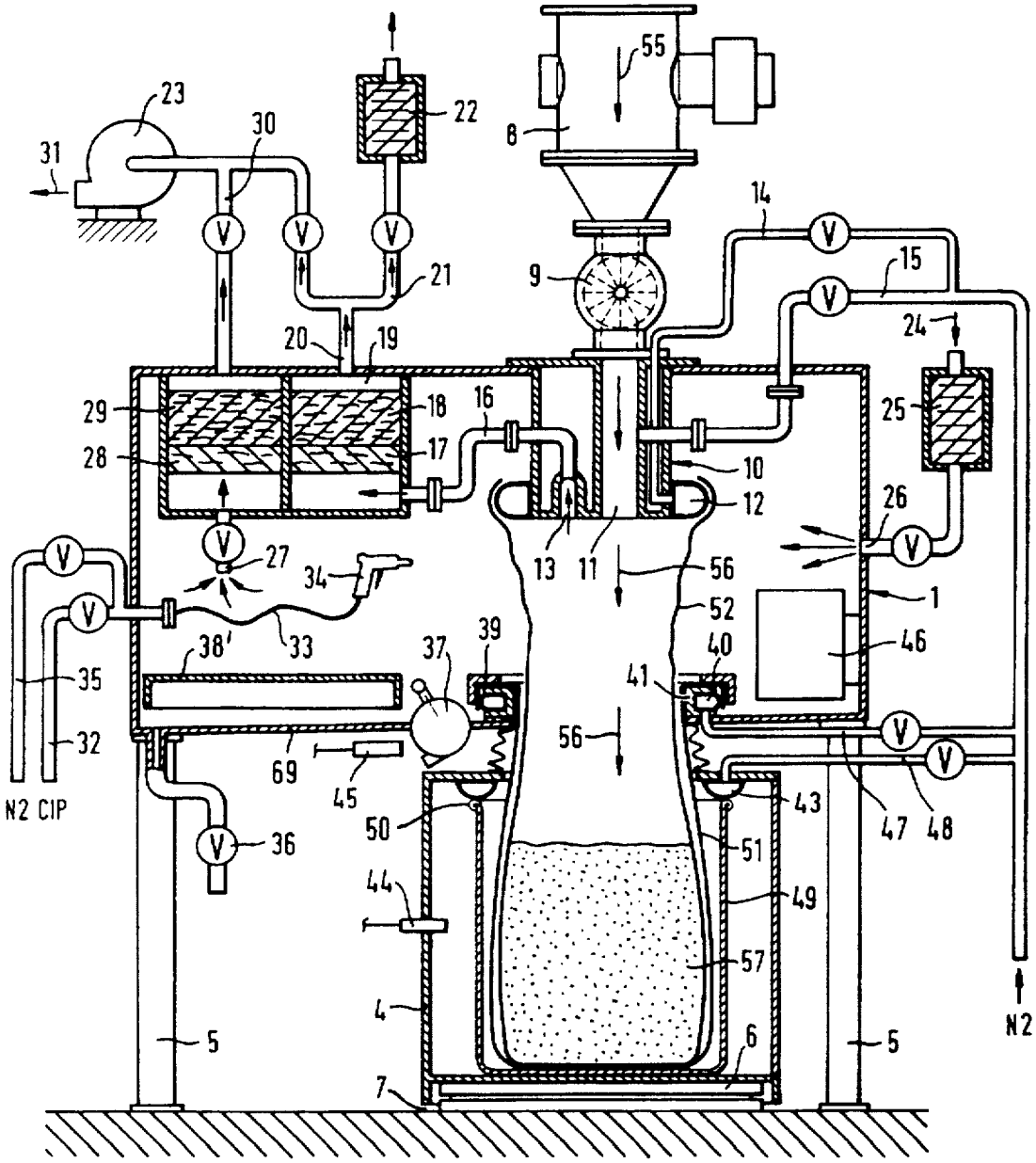
FIG. 7: the plant showing filling of the inner bag.

Going from FIG. 6 to FIG. 7, the weighing device is now tared to eliminate all extraneous weight. The actual filling operation can now begin, in which the material to be decanted (product) flows out of the discharge valve 8 when the metering device 9 is switched on, in the arrow direction 56 into the inner bag 52, and there accumulates at the bottom in the form of the product 57. The air displaced in this filling operation is drawn upwards via the pipe 16 in the arrow direction and can escape via the pipe 21.

Figure 8:
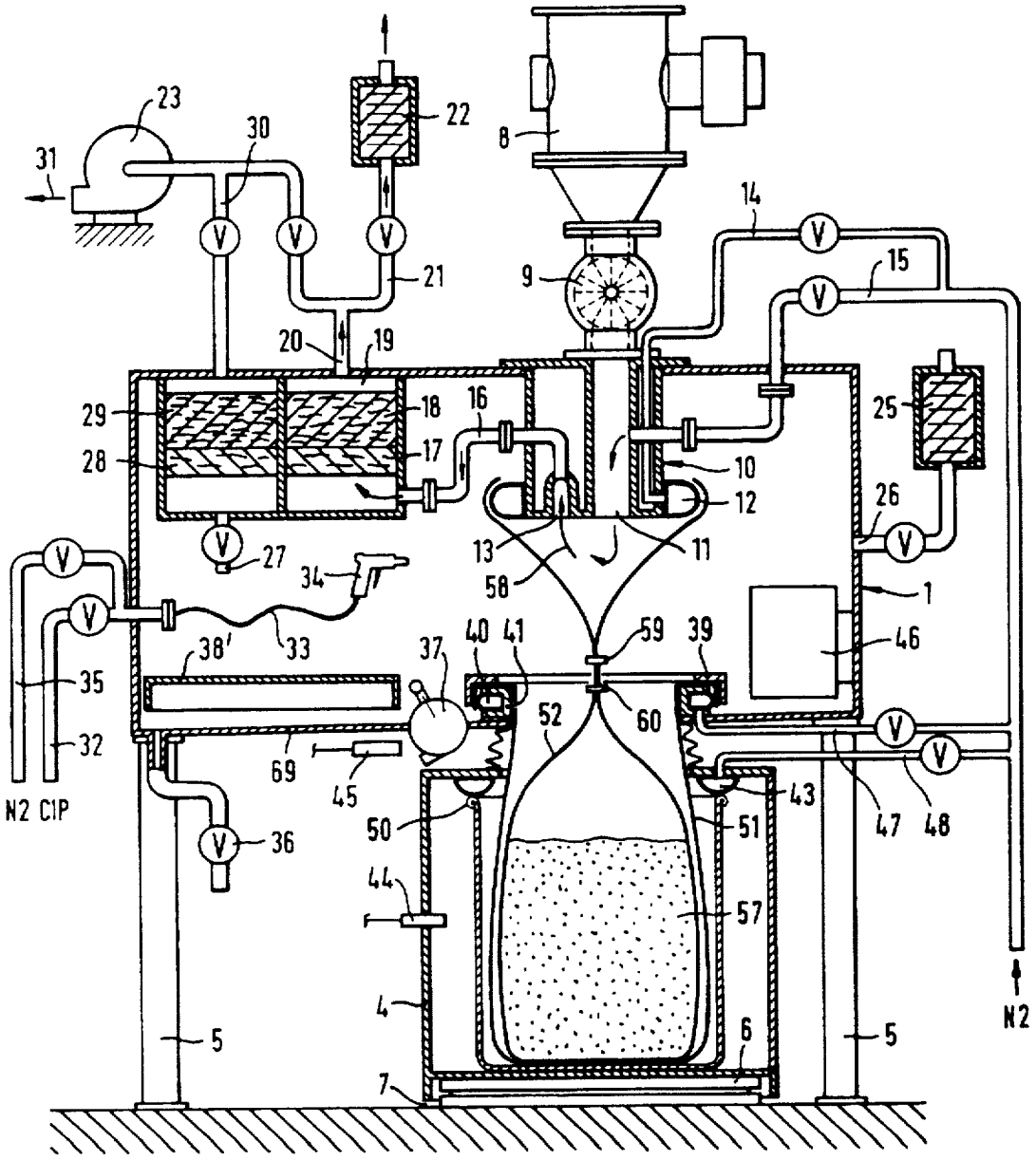
FIG. 8: the plant showing closure of the inner bag.

After filling has taken place, the weighing device signals complete filling of the inner bag 52, as a result of which product flow from the discharge valve is stopped. According to FIG. 8 the inner bag is first extracted via the extraction connection 13, wherein the bag closures 59, 60 are not yet applied. Thus evacuation of the inner bag 52 takes place, and only when it is evacuated are the bag closures 59, 60 applied. Moreover, the air is then also extracted from the filler head 10 in the arrow direction 58.

Figure 9:
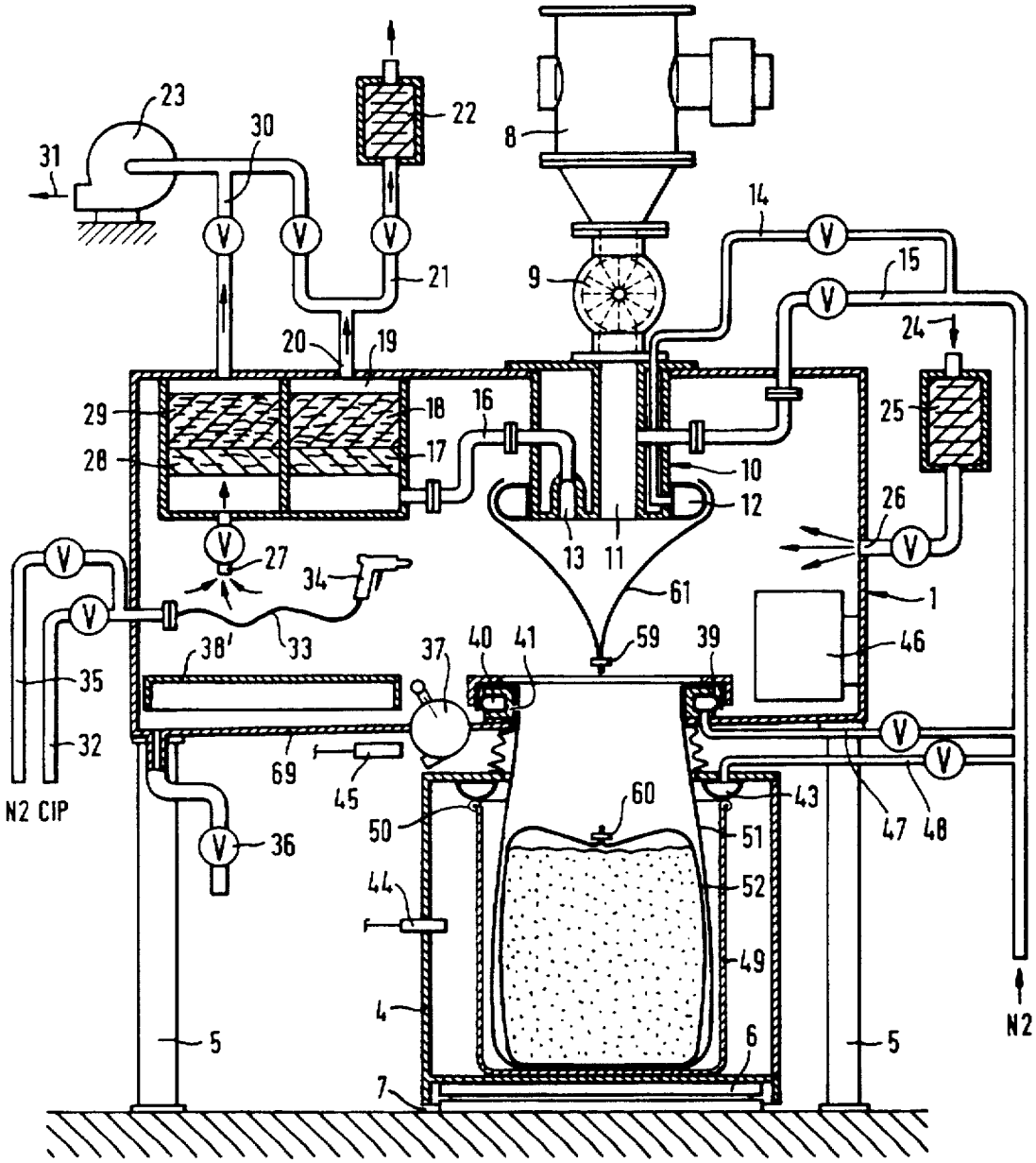
FIG. 9: the plant after cutting the connection between the upper and lower portions of the inner bag.

According to FIG. 9, a cut is now made between the upper bag closure 59 and the lower bag closure 60, as a result of which a bag remainder 61 is left on the filler head 10.

Then the inner bag 52 is stuffed back into the drum 49.

Figure 10:
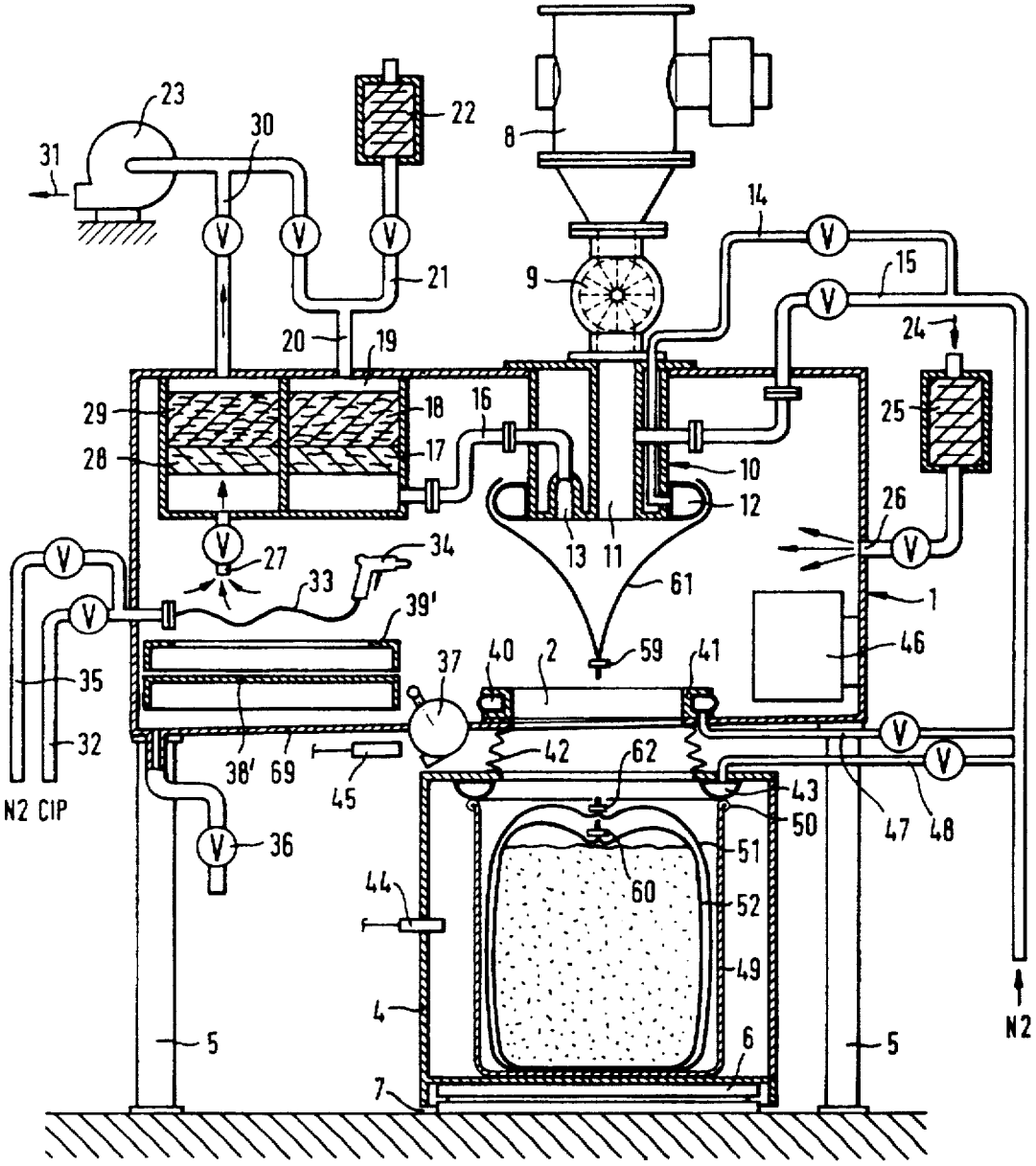
FIG. 10: the plant after introducing both bags into the drum.

According to FIG. 10 the inflatable seal 40 is deaerated and the sealing ring 39 is again moved to its position 39'. Next the outer bag 51 is closed with a bag closure 62.

By operation of the lever 37, the swinging lid is closed and then carries on its upper side the sealing ring 39. The seal 40 is inflated in order to apply the swinging lid 38 sealingly, as a result of which the opening 2 is hermetically sealed.

Figure 11:
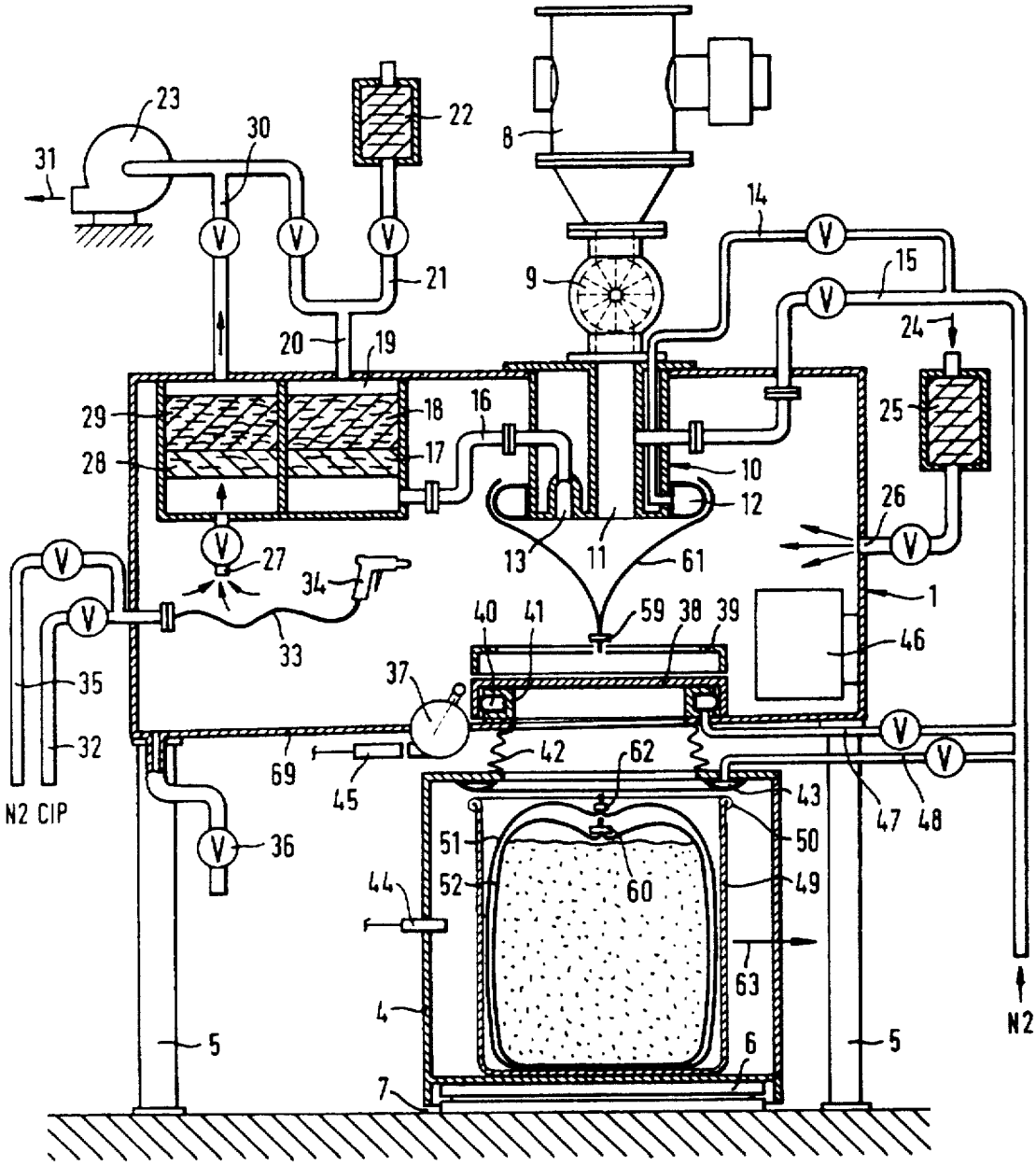
FIG. 11: the plant after closing the opening in the glove box and removing the drum.

Then according to FIG. 11 the seal 43 is deaerated, as a result of which the ring flange 50 of the drum 49 is cleared, and the latter can then be removed in the arrow direction 63 from the weighing platform 6.

The drum is then hermetically sealed with a drum lid, not shown in more detail, and an associated clamping ring.

Thus the whole procedure of filling a drum has been described.

Figure 5:
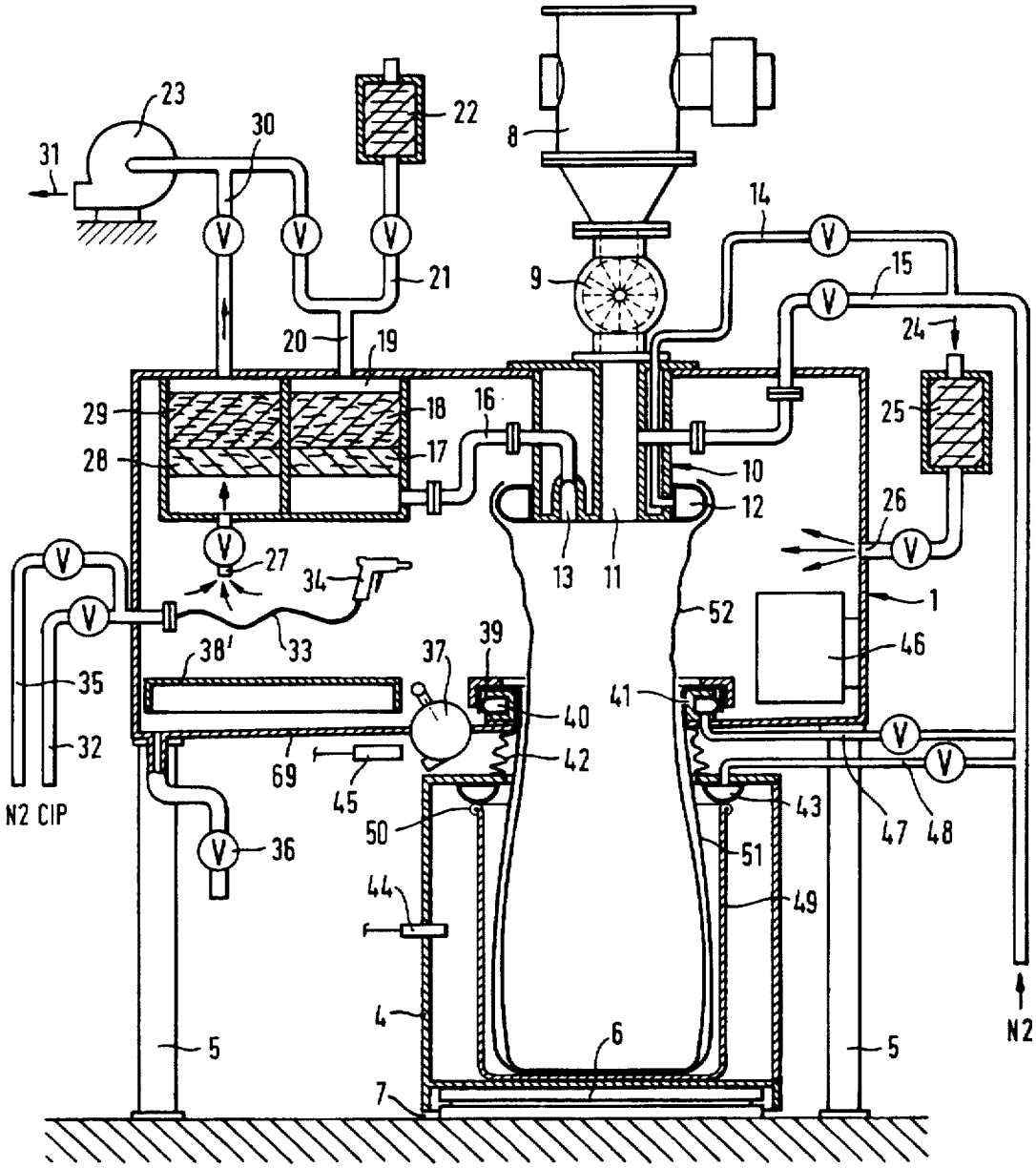
FIG. 5: the plant with the inner bag mounted.
Figure 12:
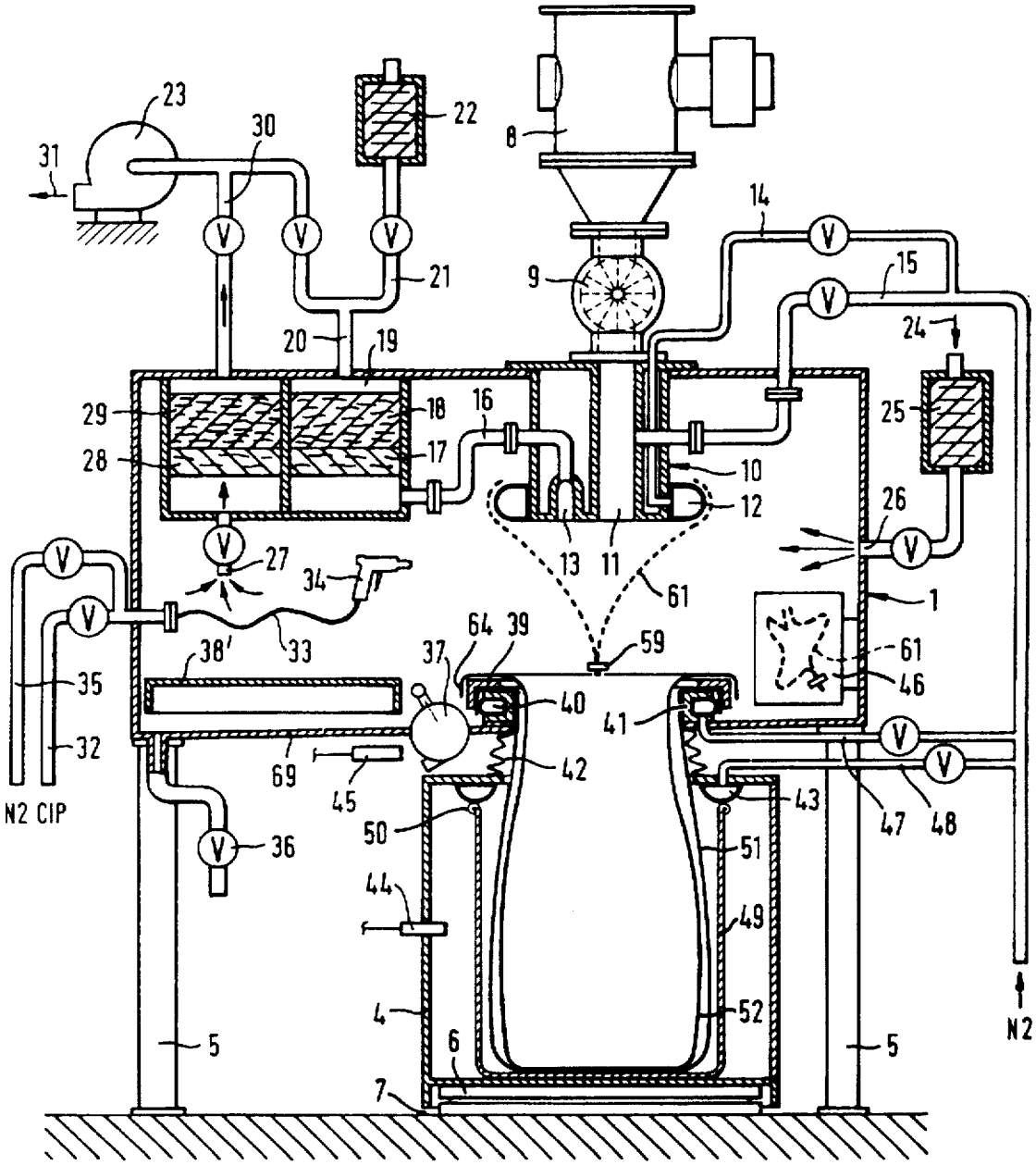
FIG. 12: the plant in an alternative embodiment in comparison with FIG. 5.

FIG. 12 shows an alternative to the state of the method in FIG. 5. For FIG. 5 showed the filling of a first bag when there is as yet no bag remainder, while FIG. 12 shows how a bag remainder 61 left in the glove box 1 is removed.

For this, it is provided that this bag remainder 61 with the seal 12 deaerated is brought into a basket 46 arranged in the chamber, and only then is the inner bag 52 according to FIG. 5 attached to the filler head 10.

At the same time according to FIG. 12 the upper edge 64 of the inner bag 52 is inverted over the sealing ring 39, in order to ensure that product particles still located in the region of the bag remainder 61 or located in the region of the filler head 10 drop into the inner bag 52 and not into the gap between the inner bag 52 and the outer bag 51.

Figure 13:
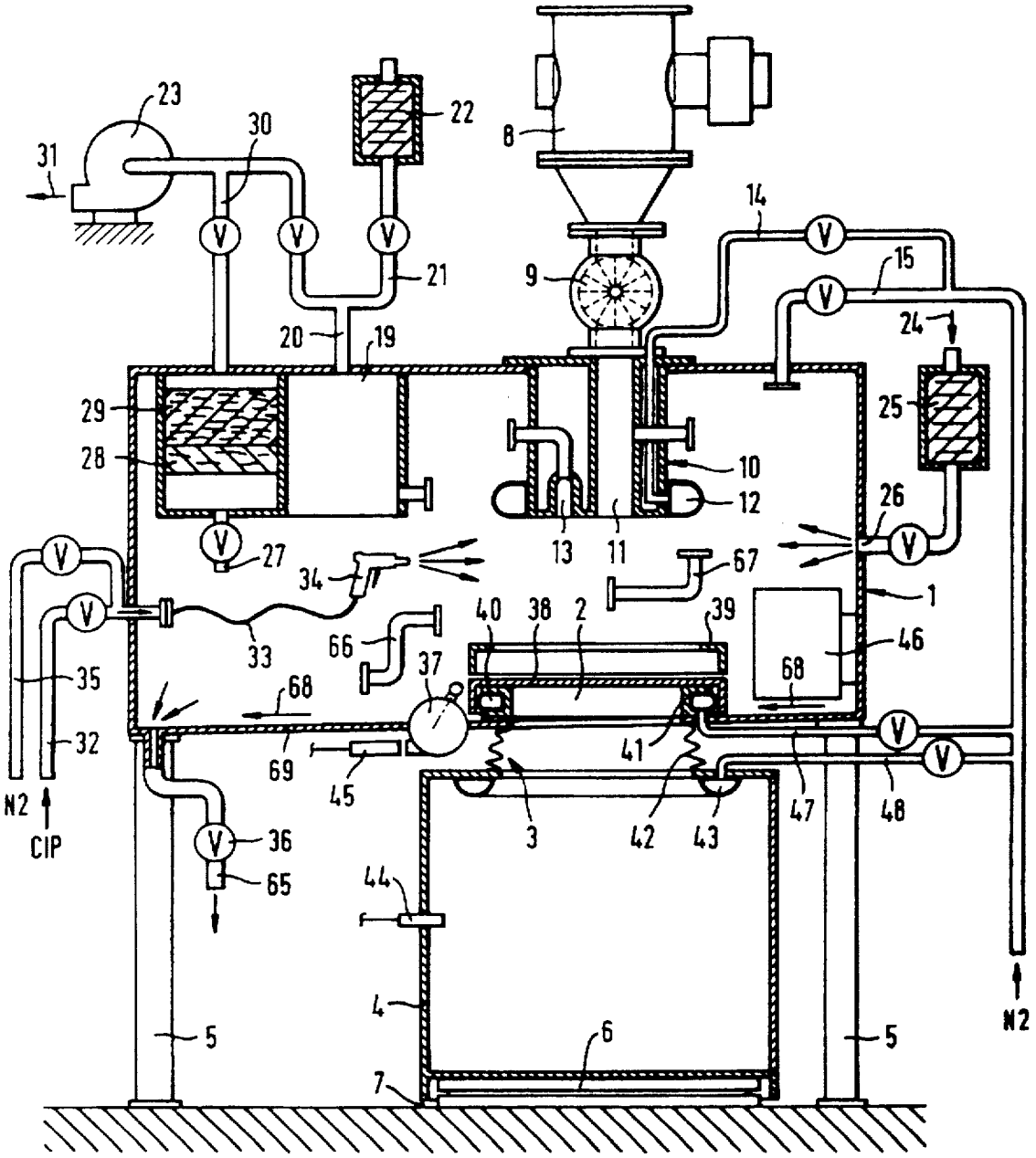
FIG. 13: the plant at a cleaning stage.

FIG. 13 shows the cleaning stage for the whole plant, where a cleaning medium is supplied via the pipe 33 and distributed via the spray gun 34 in the chamber. In this case the filters 17, 18 can be dismounted, as also the pipe sections 66, 67 which are in each case connected to the corresponding pipes by aseptic clamp fastenings.

The cleaning medium flows down over the inclined bottom plate 69 to the run-off opening above the valve 36.

The pipe 36 is connected by a valve to an outlet 65.

Figure 14:
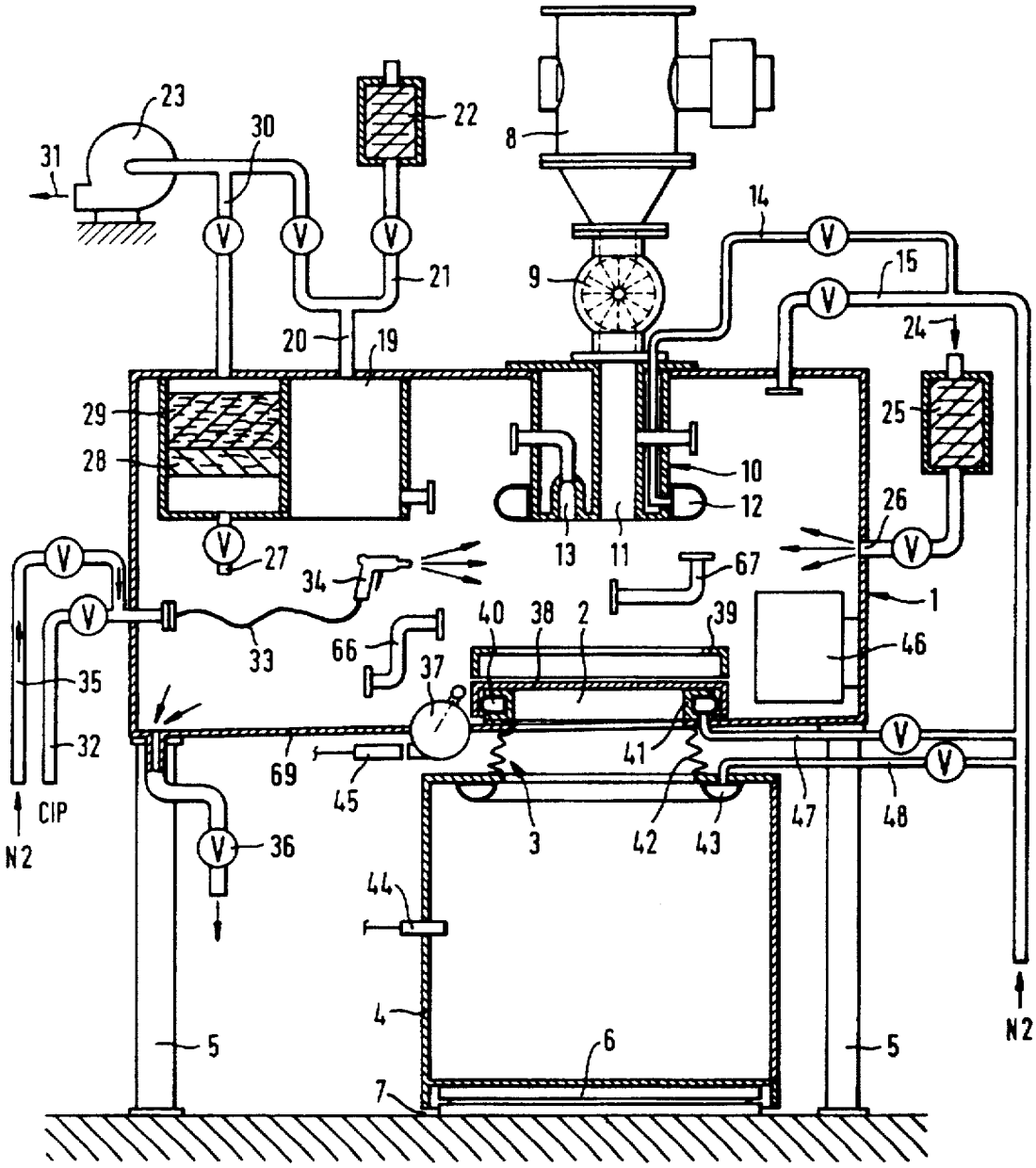
FIG. 14: the plant at the drying stage.

FIG. 14 shows the drying stage, where a drying medium e.g. hot air, an inert gas or the like is introduced via a pipe 35 and distributed via the spray gun 34 throughout the glove chamber 1. In this case when the fan 23 is switched on, the drying air can be removed from the chamber via the pipe 20, wherein more air is drawn in via the pipe 26 in the arrow direction 24.

The essence of the present invention therefore lies in the new steps of the method, that a drum is placed on the weighing device standing in the open air, and on the weighing device is arranged a weighing frame which is hermetically connected to a sealing device attached to the lower side of the glove box.

Another important step of the method is that the chamber comprises cleaning and drying means as well as special air conduction, wherein both the air from the filler head 10 and the air from the chamber itself can be removed.

What is claimed is:

1. Method for decanting hazardous substances into containers, in which the substances to be decanted are divided into portions and packaged at an outlet of a production plant via an upper glove box, a lock chamber and a drum container under clean room conditions, comprising the steps of:

a) providing a support for a drum container wherein the support is sealed against the glove box on the upper glove box on a weighing platform;

b) sealing an upper ring flange of the drum container by inflating an inflatable seal against the support;

c) opening a passage between the glove box and a space within the drum container;

d) pulling an outer bag out of the drum container over a flange in the glove box and fastening said bag;

e) fastening an inner bag from the drum container at the outlet of the production plant;

f) performing filling and weighing operations and closure of the outlet after filling has taken place;

g) evacuating the inner bag;

h) closing and stuffing into the drum container the inner bag and then the outer bag and hermetically sealing the drum container;

i) hermetically sealing the glove box off from the chamber for the drum container.

2. Method of decanting according to claim 1, wherein the inner bag, after it is fastened at the outlet of the production plant, is rendered inert by an inert gas.

3. Method of decanting according to claim 1, wherein after the glove box, after the end of the filling operation, is hermetically sealed off from the chamber for the drum container, a cleaning operation for the glove box is performed.

4. Method of decanting according to claim 3, wherein a cleaning medium is sprayed into the glove box via spray guns and drawn off again via exchangeable filters.

5. Method of decanting according to claim 4, wherein the cleaning medium flows down an inclined bottom plate of the glove box to an outlet.

6. Method of decanting according to claim 1, wherein a drying operation is added.

7. Apparatus for decanting hazardous substances into a drum container having an inner and outer bag, comprising:

a glove box having an upper, filler device, a flange and a lower opening;

a weighing platform positioned under the lower opening of the glove box;

a weighing frame arranged on the weighing platform as part of a weighing device;

said drum container within the weighing frame, the drum container having an upper ring flange;

a sealing device between the frame and the glove box lower opening whereby an opening between the glove box and the drum container serves as a lock chamber which can be hermetically sealed;

an inflatable seal in the weighing frame, said seal comprising means for contacting the upper ring flange of the drum container without pressures in relation to weighing; and means for fastening the inner bag to the filler device; means for fastening the outerbag to the glove box.

8. Apparatus for decanting according to claim 7, wherein the opening between the glove box and the drum container can be hermetically sealed via a swinging lid.

9. Apparatus for decanting according to claim 7, wherein a device is provided for introducing an inert gas.

10. Apparatus for decanting according to claim 7, wherein a cleaning device for the glove box is provided, which comprises spray nozzles for liquid or gaseous cleaning media and extraction or run-off means as well as a drying device.

11. Apparatus as claimed in claim 7, including a flange in the glove box around the lower opening for receiving the edge of the outer bag and a second sealing device for sealing the edge of the outer bag around the flange.

12. Apparatus as claimed in claim 7, including seal means for sealing the edge of the inner bag around the filler device in the glove box, and extraction means communicating with the filler device for evacuating the inner bag after filling.

* * * * *